United States Patent [19]

Murtaugh

[11] 4,167,488

[45] Sep. 11, 1979

[54] HARD SURFACE CLEANING COMPOSITIONS

[75] Inventor: Justin J. Murtaugh, Guilford, Ind.

[73] Assignee: The Drackett Company, Cincinnati, Ohio

[21] Appl. No.: 829,374

[22] Filed: Aug. 31, 1977

[51] Int. Cl.[2] ..... C11D 7/22; C11D 7/26

[52] U.S. Cl. ..... 252/160; 252/174.18; 252/DIG. 2; 252/155; 252/156; 252/525

[58] Field of Search ..... 252/160, 155, 156, 525, 252/DIG. 2, 89 R

[56] References Cited

U.S. PATENT DOCUMENTS

| | | | |
|---|---|---|---|
| 3,379,720 | 4/1968 | Reid | 252/160 UX |
| 3,379,721 | 4/1968 | Reid | 252/160 UX |
| 3,625,854 | 12/1971 | Gower et al. | 252/160 X |
| 3,658,720 | 4/1972 | McDougall et al. | 252/148 X |

*Primary Examiner*—Mayer Weinblatt

*Attorney, Agent, or Firm*—Sharon A. Blinkoff; George A. Mentis; David J. Mugford

[57] ABSTRACT

An aqueous composition for hard surface cleaning containing, by weight thereof, about 30% of an alkanolamine and about 0.8% of a water insolubilized polysaccharide having both hydroxyl and carboxyl groups, the ratio range of the free acid form to the salt form of the carboxyl groups being about 0.07/1 to 3/1. Preferably, the alkanolamine is monoethanolamine and the polysaccharide is a carboxyalkyl cellulose ether, such as a water insolubilized form of sodium carboxymethylcellulose. Preferably, the composition also contains about 0.5% of a fluorochemical and/or organo silicone type surfactant.

9 Claims, No Drawings

HARD SURFACE CLEANING COMPOSITIONS

BACKGROUND OF THE INVENTION

This invention relates to hard surface cleaning compositions. More particularly, it relates to compositions useful for removing burned-on food or other organic deposits from hard surfaces of, for example, ovens, pots, and pans. Such a composition contains primarily an aqueous solution of an alkaline material and a water insoluble, fibrous polymer, the latter of which is capable of absorbing a large volume of liquid.

When used in cooking, pots and pans are liable to soiling by burned-on organic deposits of natural fats, oils, and other residues of cooked food. When heated at normal cooking temperatures, these deposits are converted into a hard, infusible polymeric mass in which part of the deposits may be charred. Detergents scouring powders and similar cleaning products, such as dishwashing liquid products, are not adequate for removing these deposits because of their generally inpenetrable nature.

The removal of this type of soil is therefore a considerable problem, requiring generally powerful chemical or physical action. Among the most effective chemical compounds known for this purpose are the caustic alkalis, such as sodium or potassium hydroxide. They may be applied to the stained utensil directly by brush, sponge, or more conveniently by means of an aerosol spray. Products of this type, although efficient in their action, suffer from a number of disadvantages. One disadvantage is that such products when applied to soiled utensils attack the soiling matter from its outer layer, while the most severe charring and polymerization is generally present in the interior of the matter adjacent the utensil's surface. This makes removal more difficult. Second, because of the nature of the caustic alkalis and of conventional cleaning compositions having a high concentration of caustic alkali, it has been known to be necessary to employ considerable safety measures in their use. However, alkalis less alkaline than caustic alkali have not previously been found to be effective in hydrolyzing burned-on deposits in a reasonable time of application. Thus, the problem which existed prior to the invention of the compositions herein was that a cleaning composition was needed which could penetrate a burned-on deposit to effect its prompt removal and yet was not as strongly alkaline as concentrated caustic alkali.

The prior art, particularly U.S. Pat. Nos. 3,379,721; 3,591,509; and 3,663,445, discloses hard surface cleaners containing an alkaline material and water soluble sodium carboxymethylcellulose. However, it has been found that compositions containing an alkaline material, less alkaline than concentrated caustic alkali, and a water soluble form of a polysaccharide, such as sodium carboxymethylcelluose, are not good organic deposit removers. Although they may be capable of penetrating an organic deposit and do not present the same problems as do the caustic alkalis, such compositions dry rapidly and form a hard outer layer on the deposit, which makes washing the deposit off a utensil's surface difficult.

In accordance with this invention, hard surface cleaning compositions are provided which contain an alkaline material and a fibrous, water insoluble polymer capable of absorbing a large amount of water, so that when such a composition is applied to a deposit, the above mentioned hard outer layer is not formed and the deposit may be easily washed off.

SUMMARY OF THE INVENTION

An aqueous hard surface cleaning composition is provided. The composition contains, by weight thereof, a minimum of about 5% of an alkanolamine. Preferably, the alkanolamine is monoethanolamine, but mixtures of alkanolamines or other alkanolamines can also be used. Further, the composition contains, by weight thereof, a polymer having both carboxyl and hydroxyl groups, wherein the ratio range of the free acid form to the salt form of the carboxyl groups is about 0.07/1 to about 3/1. Preferably, the polymer is a polysaccharide, such as a starch, natural gum, and/or ether or ester of cellulose, starch, or natural gum, or mixtures thereof. The composition may also contain surfactants and other agents conventionally found in hard surface cleaners, such as corrosion inhibitors and antifoamers.

DISCUSSION OF THE PREFERRED EMBODIMENTS

The alkaline ingredient of these compositions acts to penetrate and loosen from the surface to be cleaned burned-on organic deposits. Although this ingredient could be an alkali metal hydroxide or ammonia, preferably it is an alkanolamine. Most preferably, it is monoethanolamine (MEA). One advantage of MEA, for example, is that it is not as volatile and does not have as strong an odor as ammonia. However, for particular applications, these other alkaline ingredients and other alkanolamines can be used to replace either part or all of the MEA in these compositions. The alkaline ingredient should be present in these compositions in a minimum amount of about 5%, by weight, but preferably it will constitute about 20% to 40% of any such composition.

One type of water insoluble polymer beleived to be useful in these compositions are the hydrolyzed starch, polyacrylonitrile graft copolymers. Another are polymers having both hydroxyl and carboxyl groups, such as the polysaccharides, in which the carboxyl groups therein have a ratio of about 0.07/1 to about 3/1 for those in the free acid form to those in the salt form. As described in U.S. Pat. No. 3,379,720, the disclosure of which is incorporated by reference herein, such polymers are cured by various processes to become water insoluble. Preferred polysaccharides are starch, natural gums, esters and ethers of starch, natural gums, and cellulose, and mixtures thereof. A particularly preferred polysaccharide is a carboxyalkyl cellulose ether such as sodium carboxymethylcellulose, which has been cured as described in the above referred to patent.

As discussed in *Bulletin VC*-494 and *Product Data Publication No.* 461-1 of Hercules Inc., Wilmington, Del., the form of carboxymethylcellulose (CMC) described in the above U.S. Patent, which has been found to be most useful in these compositions, is commercially available from Hercules Inc. under the trademark "Aqualon".

"Aqualon" is a highly absorbent modified cotton linters. Different from CMC, "Aqualon" is believed to be internally crosslinked to insure that its fibers are essentially water insoluble. The greater liquid absorbability of "Agualon" is believed to contribute to the effectiveness of these compositions, as discussed further below. Typical properties of "Aqualon," or similarly of another polymeric material which may be employed in these compositions, are as follows:

| PROPERTIES | VALUES |
|---|---|
| Color (TAPPI brightness) | 85 to 90 |
| Moisture Content, %, | 8.0 |
| Degree of substitution (DS) | 0.7 |
| Water absorbency, ml/g | |
| Immersion/centrifuge test[a] | |
| Aqualon C | 35 to 45 |
| Aqualon R | 25 to 35 |
| Average fiber length mm | 3.0 |
| pH (1% solids aqueous dispersion) | 5 to 7 |

[a]Water absorbency measurement by immersion/centrifuge test.

In this test, 1 g of absorbing fiber is well dispersed in 100 ml of water by tumbling for 2 hrs in an 8 oz centrifuge bottle. The bottle is then placed in a centrifuge (International Centrifuge Model BE 50) and subjected to a centrifugal force of 3,000 g for 20 min. Any free water is decanted off and measured volumetrically. The absorbency in ml/g is calculated by deducting from 100 the volume (in ml) of free water. This test also represents a measure of the water retention capacity of the fibers.

It has been found that when an "Aqualon," such as Aqualon C stated above, is ground to a fine powder and suspended in an ammonia or MEA aqueous solution, the mixture thereof becomes quite viscous and essentially transparent. When sprayed onto a surface, even a vertical surface, the mixture clings to the surface holding the ammonia or MEA in contact therewith, so that the organic deposits to be removed are well treated. It is believed that the "Aqualon" is not actually in solution but forms a film, which does not completely dry but retains some moisture so that is easily washed off the surface along with the treated organic deposits. Preferably, the water insoluble polymer of one of these compositions is present in an amount between about 0.6% to about 1.0%, by weight thereof, but may be present in an amount between about 0.3% to about 1.5%.

To enhance the activity of these compositions, surfactants, wetting agents, and/or other agents conventionally found in hard surface cleaners may be incorporated therein.

Fluorochemical surfactants have been found to be useful in these compositions for wetting and reducing surface tension. Typical surfactants are alkali metal fluorinated alkyl carboxylates, fluorinated alkyl quaternary ammonium iodides, and fluorinated alkyl polyoxyethylene ethanols. These surfactants are available from the Minnesota Mining and Manufacturing Company under the trademark "Fluorad." Particular "Fluorad" series surfactants which have been found to be most useful in these compositions are identified as FC-128, FC-134, and FC-170. Preferably, such a surfactant is present in an amount between about 0.07 to about 0.2%, by weight, of such a composition, but may be present in an amount between about 0.02 to about 1.0%.

Another type of surfactant found to be useful in these compositions is of the organo silicone type, such as the organosilane esters. This type of surfactant, particularly the L-70 series surfactants described in the Union Carbide Co. publication entitled 1969 *Silicones For the Chemical Industry,* (1968), has been found to be very compatible with the "Fluorad" surfactants described above. It is believed that this compatability enhances the capacity of these compositions to remove organic deposits from a hard surface. This surfactant has been found to be useful in the same amount as described above for the "Fluorad" surfactants.

Other agents useful in these compositions are corrosion inhibitors, such as sodium metasilicate, which may be present in an amount between about 0.1 to about 0.5%, by weight, of such a composition and antifoaming agents, such as those of the "Antifoam" series available from the Dow Corning Company, which may be present in an amount between about 0.01 to about 0.04%, by weight thereof.

The following compositions were made and tested for removal of organic deposits from a hard surface.

EXAMPLE I 1.5 g. of Aqualon C[1] was ground to a fine powder and suspended by stirring into 73.5 g. of water. 0.75 g. of MEA was added thereto and stirred for 15 minutes. The resulting viscous, transparent mixture was held at room temperature for two hours. To this solution was added, with stirring, a mixture of 0.1 g. of sodium lauryl sulfate, 0.2 g. of L-77[2] surfactant, 0.2 g. of FC-170[3] surfactant, 0.2 g. of lemon fragrance, 0.6 g. of sodium meta silicate, and 0.02 g. of Antifoam Q[4] antifoamer, which had previously been mixed with 39.25 q. of MEA dissolved in 83.68 g. of water. The resulting liquid was semi-transparent and viscous. When sprayed from a spray bottle onto test panels having burned-on food stains and allowed to stand for 10 minutes, the stains could be washed off without difficulty.

[1] Hercules Inc. "Aqualon" series CMC
[2] Union Carbide Co. L-70 series surfactant.
[3] Minnesota Mining and Manufacturing Co. "Fluorad" surfactant.
[4] Dow Corning Co. "Antifoam" antifoamer.

EXAMPLE II 20.0 g. of MEA, 2.0 g. of 10% sodium lauryl sulfate, and 0.2 g. of FC-128[5] were mixed with 27.8 g. of water. 50 g. of 2% Agualon C solution was added thereto, which resulted in a clear viscous solution. 20 minutes after application to test panels having burned-on food stains, the stains were easily washed off.

[5] Minnesota Mining and Manufacturing Co. "Fluorad" surfactant.

EXAMPLE III 40.0 g. of MEA, 2.0 g. of 10% sodium lauryl sulfate, 0.15 g. of L-77 surfactant, and 0.15 g. of FC-170 surfactant, were mixed with 57.70 g. of water. 100 g. of 2% Agualon C solution was added thereto, which resulted in a clear viscous solution. 20 minutes after application to test panels having burned-on food stains, the stains were easily washed off.

EXAMPLE IV 20 g. of MEA and 0.2 g. of FC-128 surfactant were mixed with 79.8 g. of water. To test panels having burned-on food stains, this composition was applied to one side of the panels and the composition of EXAMPLE II was applied to the other side of the panels. After a 20 minute application, the sides of the panels having thereon this composition did not wash off as easily as the sides having thereon the composition of EXAMPLE II.

EXAMPLE V

Test panels were divided into three parts. The composition of EXAMPLE IV was applied to one part of the panels. The composition of EXAMPLE IV to which 0.2 g. of 10% sodium lauryl sulfate had been added was applied to another part of each of the panels.

To the third part of each of the panels was applied a composition of 20 g. of MEA, 0.2 g. of FC-128 surfactant, and 50 g. of 2% Aqualon C solution mixed with 29.8 g. of water. 15 minutes after application to the panels and after being soaked for 5 minutes in a 1% solution of a common household dish washing product, the part of the panels to which the last composition had been applied washed off most easily.

What is claimed is:

1. A composition for hard surface cleaning consisting essentially of a minimum amount of about 5%, by weight thereof, of an alkanolamine selected from the group consisting of monoethanolamine, diethanolamine, triethanolamine, and mixtures thereof, an amount between about 0.3% and about 1.5%, by weight thereof, of a water insolubilized polysachharide having hydroxyl and carboxyl groups, the ratio range of the free acid form to the salt form of the carboxyl groups being about 0.07/1 to about 3/1, and up to about 93.5%, by weight thereof, of water.

2. The composition of claim 1 wherein the polysaccharide is selected from the group consisting of starch, natural gums, and ethers and esters of cellulose, starch, and natural gums, and mixtures thereof.

3. The composition of claim 1 wherein the polysaccharide is a cellulose ether.

4. The composition of claim 1 wherein the polysaccharide is a carboxyalkyl cellulose ether.

5. The composition of claim 1 wherein the polysaccharide is carboxymethylcellulose.

6. The composition of claim 1 wherein the alkanolamine is monoethanolamine.

7. The composition of claim 1 wherein the alkanolamine is present in an amount between about 20% and 40%, by weight, of the composition.

8. The composition of claim 1 wherein the polysaccharide is present in an amount between about 0.6% and 1.0%, by weight, of the composition.

9. The composition of claim 1 comprising, by weight thereof, about 20% to about 40% of monoethanolamine and about 0.6% to about 1.0% of sodium carboxymethylcellulose.

* * * * *